US007475499B2

(12) United States Patent
Robben

(10) Patent No.: US 7,475,499 B2
(45) Date of Patent: Jan. 13, 2009

(54) DEVICE FOR NEUTRALIZING THE SLIPPERINESS OF WET FROZEN SURFACES

(76) Inventor: John Ferris Robben, One Janet Ct., Riverside, CT (US) 06870

( * ) Notice: Subject to any disclaimer, the term of this patent is extended or adjusted under 35 U.S.C. 154(b) by 394 days.

(21) Appl. No.: 11/338,370

(22) Filed: Jan. 25, 2006

(65) Prior Publication Data

US 2007/0193067 A1 Aug. 23, 2007

(51) Int. Cl.

| | |
|---|---|
| ***A43B 1/06*** | (2006.01) |
| ***A43C 15/02*** | (2006.01) |
| ***A41D 13/08*** | (2006.01) |
| ***B32B 5/00*** | (2006.01) |

(52) U.S. Cl. ..... 36/86; 36/59 R; 2/62; 2/16; 428/98

(58) Field of Classification Search ..... 36/86, 36/59 R, 59 C

See application file for complete search history.

(56) References Cited

U.S. PATENT DOCUMENTS

| | | | | |
|---|---|---|---|---|
| 1,328,665 | A * | 1/1920 | Gillenwaters | 36/84 |
| 3,027,661 | A * | 4/1962 | McCord | 36/30 R |
| 3,672,077 | A * | 6/1972 | Coles | 36/134 |
| 4,118,878 | A | 10/1978 | Semon | 36/59 |
| 5,694,704 | A | 12/1997 | Kasbrick | 36/7.6 |
| 5,996,258 | A * | 12/1999 | Simmons | 36/72 R |
| 2004/0005454 | A1 | 1/2004 | Full et al. | 428/343 |
| 2004/0194342 | A1 | 10/2004 | Steinberg | 36/11.5 |
| 2007/0022585 | A1* | 2/2007 | Pederson | 24/714.8 |
| 2008/0086825 | A1* | 4/2008 | Mullen | 12/142 Q |

OTHER PUBLICATIONS

Wikipedia—The Free Encyclopedia—see definition of Sandal (footwear); http//wikipedia.org/wiki/Sandal_(footwear).*

Enclopedia of American Indian Costume by Josephine Paterek, published in 1996, see p. 190; found on-line at books.google.com/books? and search Encyclopedia of American Costume, p. 190, under "footwear".* http://www.indianchild.com/fashion/mens-sandals.htm, copyright 2004.*

Engineer's Handbook Reference Tables-Coefficint of Friction Mar. 7, 2007.

Bamboo fooring test result datasheet Mar. 7, 2007.

NYTimes.com Jun. 11, 2008 p. 1 article "Can Rice Lead to gold? Marathon Will offer Test."

* cited by examiner

*Primary Examiner*—Ted Kavanaugh
(74) *Attorney, Agent, or Firm*—William W. Jones

(57) ABSTRACT

Traction on wet slippery icy and/or snowy surfaces is improved by the use bamboo leaves which are disposed on articles which engage the slippery surfaces. The bamboo leaves are disposed on the articles in question with the underside of the bamboo leaves oriented so as to engage the slippery surfaces. The bamboo leaves are preferably cut into shaped forms such as circles, squares or the like, which are releasably secured to the articles in question. The securement can be accomplished with releasable adhesives or releasable hook and loop devices. Articles to which the bamboo leaves can be secured include footwear, gloves, crutches, canes, walkers, vehicle tires and any other articles that would benefit from improved traction on slippery icy and/or snowy surfaces. When the hook and loop securement option is used, one sheet of the hook and loop material will be secured to a surface of the bamboo leaf shaped forms and a complementary sheet of the hook and loop material will be secured to the article in question.

7 Claims, 2 Drawing Sheets

DEVICE FOR NEUTRALIZING THE SLIPPERINESS OF WET FROZEN SURFACES

TECHNICAL FIELD

The present invention relates to a device for neutralizing the slipperiness of wet frozen surfaces, such as ice, snow and the like so as to render such surfaces less slippery when contacted by the device, and to methods for making the device. This invention also relates to useful articles which include the device and to methods for making such articles.

BACKGROUND OF THE INVENTION

The problem of being able to increase traction on slippery substances and surfaces, such as ice or snow and the like has been addressed in a number of ways in the past. One solution to this problem has involved the use of metal devices such as cleats, studs, chains, or the like, which will dig into the slippery substance or surface when the latter is contacted by something employing the metal devices. Articles which have employed such devices include footwear, such as shoes and boots, vehicle tires, to mention a few. U.S. Pat. No. 5,909,945 is illustrative of one of the many devices which have been proposed for use with footwear to render snow and/or ice less slippery to walk on.

These metal devices which have been proposed in the past are generally suitable for their intended purpose, however, they all suffer from certain drawbacks and short comings. Footwear which is equipped with these metal devices is unsafe for use on surfaces such as marble or granite floors, and can damage other surfaces such as tile or wood floors, or the like. Generally speaking, such footwear is unsuitable for wearing indoors or on hard or slippery surfaces which are not icy or snowy. This footwear is also unsuitable for wearing on some icy surfaces such as on skating rinks where the ice can be damaged by the metal devices on the footwear. Also, if one is engaged in certain winter activities such as skiing or snow shoeing, this type of footwear is not suitable since it cannot be worn on skis or on snowshoes for fear of damaging the skis and snowshoes.

Vehicle tires that have been fitted with metal anti-skid devices such as metal studs or metal chains are likewise not suited for use on pavement that has been cleared of ice and snow, or on indoor concrete surfaces such as parking lots or parking garages. In fact, the use of metal studded fires and metal tire chains has been outlawed in some states because of the damage they cause to bare pavement.

In order to deal with the above shortcomings that are found in connection with metal devices to ameliorate slipping and skidding problems stemming from poor traction on icy or snowy surfaces, the use of sand, salt, kitty litter and the like materials has been proposed for sprinkling on the icy or snowy slippery surfaces, but that solution is not practical in dealing with many such traction problems.

It would be desirable to have a solution to the traction problem for footwear, vehicle tires, and the like which solution would not present the problems that are noted above in connection with the use of metal friction-enhancing devices described above.

DISCLOSURE OF THE INVENTION

This invention relates to a solution to the problem of enhancing traction on icy or snowy surfaces which solution does not rely on metal devices to solve the problem. This invention makes use of a slip-retarding and/or skid-retarding characteristic of bamboo leaves. When the undersides of bamboo leaves are brought into engagement with an icy or snowy surface that is slippery and thus difficult to walk or drive on, the bamboo leaves will counter the slipperiness of such surfaces so as render them less difficult to walk or drive on. The bamboo leaves resist skidding, slipping or sliding on the icy or snowy surface and yet can easily be lifted away from the slippery surface with no problem. Thus, by attaching the bamboo leaves to articles of commerce which are intended to or likely to encounter slippery icy or snowy surfaces, one can increase the degree of traction that the article can attain on the slippery surfaces. At the same time, the bamboo leaves will not damage materials such as wood, tile, concrete, asphalt, or the like, when surfaces of any article to which the bamboo leaves are attached come into contact with such materials.

Articles utilizing the traction-enhancing bamboo leaves can have the leaves attached to them in a number of different ways. One simple way is to form the leaves as adjunct devices, such as shaped strips, that can be releasably attached to the articles in question. For example, assume that one desires to increase the traction of footwear such as shoes or boots by appropriately equipping the footwear with the bamboo leaves. The leaves can be cut into shaped strips such as circles or the like so that a number of the shaped leaf strips can be attached to the soles of the footwear. One way to attach the shaped leaf strips to the soles of footwear is to use a releasable adhesive which is coated onto the surface of the shaped leaf strips that abuts the footwear soles. Using this approach, the shaped leaf strips can be easily removed from the footwear when they wear down and replaced with fresh shaped leaf strips. Instead of using a releasable adhesive, one could affix complementary shaped strips of a hook and loop fastening device to the footwear soles and adhere mating shaped strips of the hook and loop fastening device to the side of the bamboo leaf strips which does not possess the traction enhancing ability. The shaped bamboo strips can then be releasably secured to the soles of the footwear and easily replaced when necessary. Exemplary hook and loop fasteners of this type are sold under the trademark VELCRO.

Another article that could benefit from the addition of the subject bamboo leaf strips is a skid resistant pad for use, for example, under or on the wheels of a vehicle so as to improve the traction of the vehicle wheels on snow and/or ice. The pad itself could be formed from rubber or some other material that the shaped bamboo strips could be releasably adhered to. The pad could also be formed from a rigid sheet material that could use the VELCRO fastening system for releasable securement of the bamboo leaf strips thereto.

Traction of essentially any article that may contact ice and/or snow could be improved by combining the article with the bamboo leaf strips. As noted above, such articles could include other articles of clothing such as knee pads, gloves, elbow pads and any other garments which are likely to come into contact with such slippery surfaces. Likewise, articles such as canes, crutches, walkers, vehicle tire covers, walkway carpets, vehicle traction mats, wheelchairs, to name a few, can be provided with improved ice and snow traction if equipped with the bamboo leaf strips.

Exemplary embodiments of articles which employ the traction-enhancing bamboo leaf strips of this invention to improve the articles' traction on slippery surfaces such as ice and/or snow are described hereinafter.

SPECIFIC MODE FOR CARRYING OUT THE INVENTION

Figure 1:
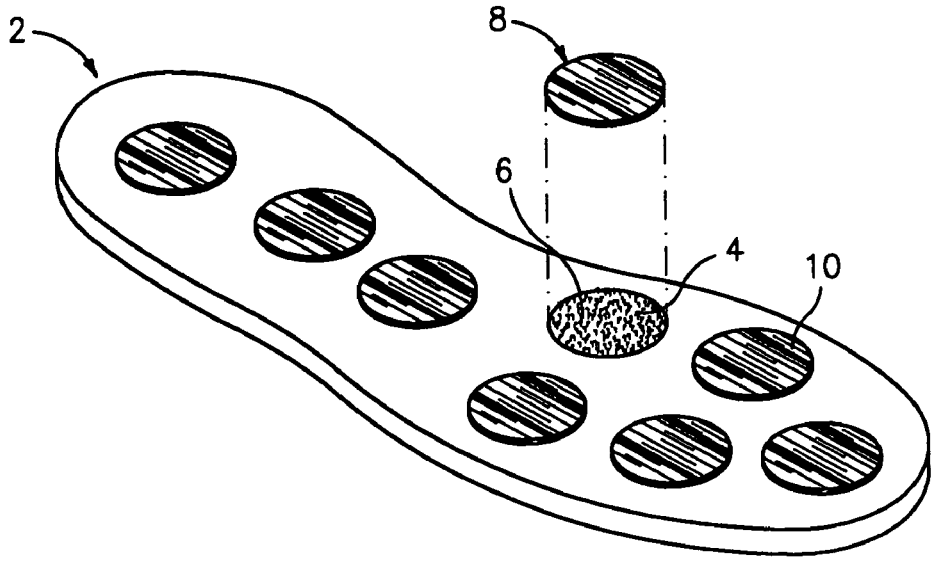
FIG. 1 is a partially exploded perspective view of the sole of an article of footwear, such as a shoe which includes the traction-enhancing bamboo leaf strip adjuncts of this invention.
Figure 2:
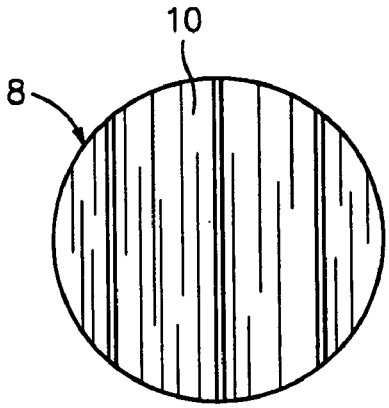
FIG. 2 is a plan view of the side of one of the shaped bamboo strips that faces the slippery snow or ice surface in question.
Figure 3:
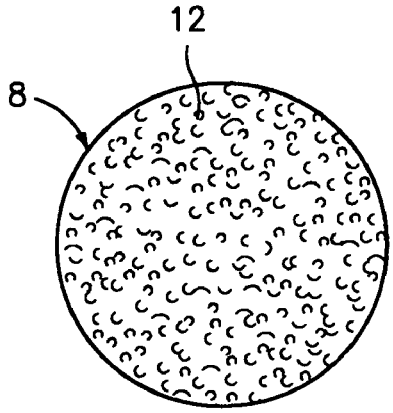
FIG. 3 is a plan view of the opposite side of the shaped bamboo strip shown in FIG. 2.

Referring now to FIG. 1, there is shown the sole of a shoe or other item of footwear which is denoted generally by the numeral 2. The item 2 can be formed from any conventional footwear material such as leather, rubber, composites, or the like. The sole 2 has a plurality of recesses 4 formed therein. The recesses 4 can be countersunk into the material or can be molded therein when the item 2 is initially formed. In the embodiment shown in FIG. 1, the recesses are circular, which is the preferred form for them. The recesses 4 contain discs 6 which are formed from a releasable securement hook and loop material. Each of the recesses 4 have matching discs 8 of traction-improving material disposed therein. The discs 8 include outer layers 10 which are formed from shaped strips of bamboo leaves. As noted in FIGS. 2 and 3, the bamboo leaf layers 10 are on the outer surface of the discs 8 and the inner layers of the discs 8 are formed from a hook and loop material 12 which is complementary to the hook and loop material 6 in the recesses 4. Thus, the discs 8 can be releasably secured to the sole 2 in each of the recesses 4 so as to improve the traction of the sole 2 on slippery icy or snowy surfaces. When the bamboo leaf layers 10 degrade from use, they can be replaced with fresh bamboo 10 on new discs 8. This technique can be used to form a large variety of high traction items of the type referred to above. It will be appreciated that the hook and loop discs 6 can be secured to the sole 2 by an appropriate adhesive material, and that the bamboo leaf layers 10 can be secured to their hook and loop layers 12 by an appropriate adhesive.

Figure 4:
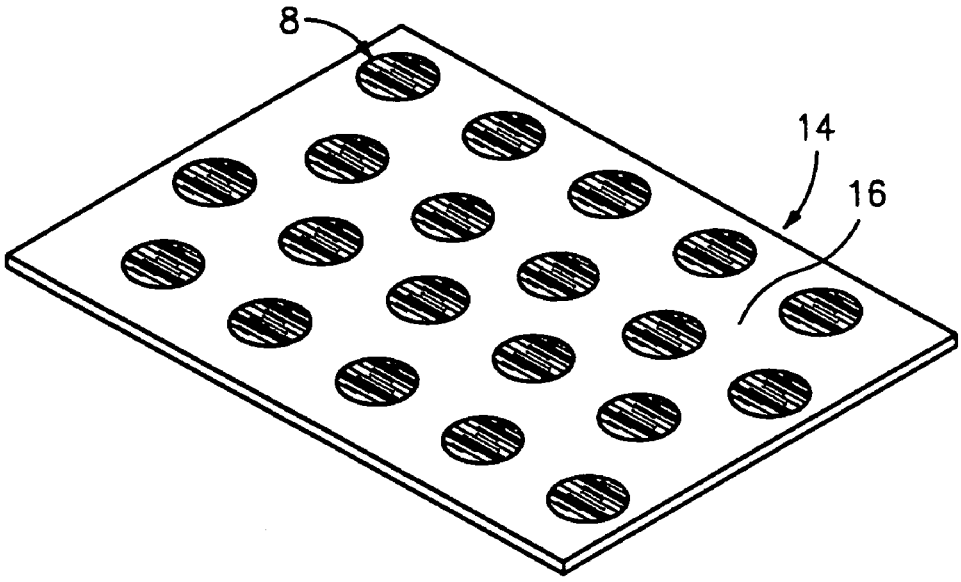
FIG. 4 is a perspective view of a mat which includes the traction-enhancing bamboo leaf strip adjuncts of this invention.

Referring now to FIG. 4, there is shown a mat or sheet 14 which may be used to provide increased traction for vehicles on wet slippery icy or snowy surfaces, or may be used on walkways to improve pedestrian traction on such surfaces. One or both surfaces 16 of the mat 14 is provided with the bamboo leaf discs 8 for the purpose of providing the needed additional traction. The discs 8 can be attached to the mat 14 in the same manner as discussed above in connection with attaching them to footwear. In use, the bamboo leaf disc side of the mat 14 will be placed in contact with the slippery surface. When both surfaces of the mat 14 are provided with the bamboo leaf members 8, both surfaces will exhibit improved traction. It will be appreciated that the discs 8 can be replaced if and when so desired.

Figure 5:
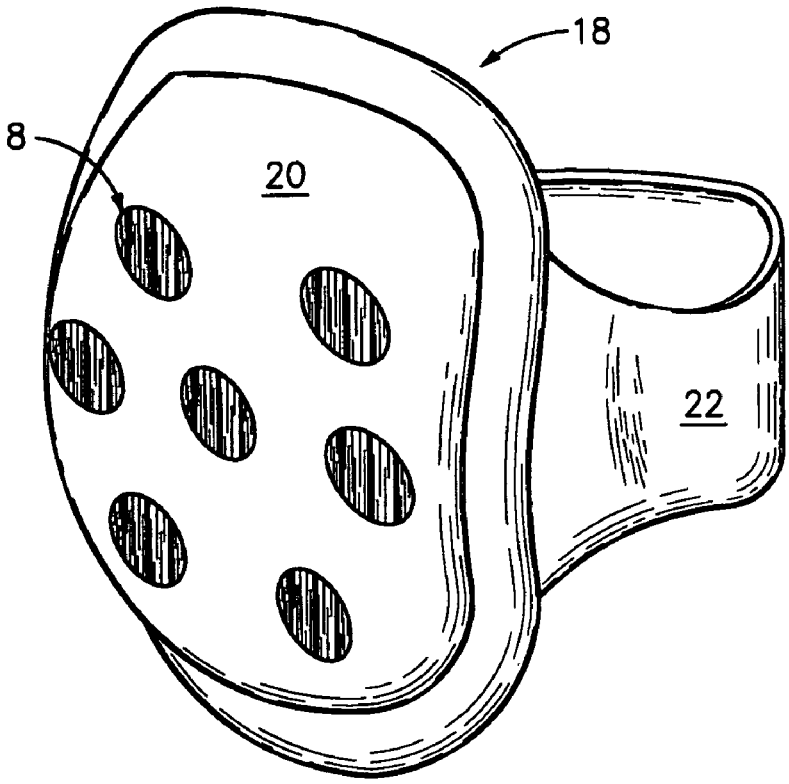
FIG. 5 is a perspective view of a pad for elbows or knees which includes the traction-enhancing bamboo leaf strip adjuncts of this invention.

Referring now to FIG. 5, there is shown an elbow or knee pad 18 which has been equipped with the bamboo leaf discs 8 so as to improve the surface traction of the pad 18 when contacting wet slippery icy or snowy surfaces. The pad 18 includes a surface 20 on which the discs 8 are disposed, and a sleeve part 22 which fits around one's appendage. Pads 18 which are equipped with the bamboo leaf members 8 will supply improved traction to persons wearing them on wet slippery icy and/or snowy terrain. Thus skiers, snowshoers, climbers, and the like, can find the pads 18 to be useful adjuncts for supplying increased traction and stability on such surfaces.

It will be appreciated from the above that the ability of the under surface of bamboo leaves to provide improved traction on wet and slippery icy and/or snowy surfaces can be put to good use in a manner which will likewise improve the traction of any article or object to which the bamboo leaves are appropriately attached. Eleven different species of bamboo leaves have been tested for the presence of the improved traction property, and all of the tested species were found to possess it. Tested bamboo species include: *arundinaria gigantea, phyllostachys bissetti, phyllostachys nigra, phyllostachys bambusoides, phyllostachys henon, indocalamus tessellatus, phyllostachys aureosulcata, phyllostachys edulis, phyllostachys rubromarginata, pseudosasa japonica*, and *phyllostachys aurea.*

Since many changes and variations of the disclosed embodiment of the invention may be made without departing from the inventive concept, it is not intended to limit the invention otherwise than as required by the appended claims.

What is claimed is:

1. A device for increasing traction on wet slippery icy and/or snowy surfaces, said device comprising a component which includes a bamboo leaf wherein an undersurface of the bamboo leaf is oriented so as to contact the wet slippery icy and/or snowy surfaces, said device including a support member to which said bamboo leaf is secured, said support member being operative to provide a releasable securement of said bamboo leaf to an adjunct article or object.

2. The device of claim 1 wherein said bamboo leaf is precut to a predetermined shape.

3. A cut pre formed assembly for providing improved traction for an adjunct article or object contacting wet slippery icy and/or snowy surfaces, said assembly comprising:

a) a releasable adherent member forming one surface of said assembly; and b) a bamboo leaf member forming an opposite surface of said device said bamboo leaf member being secured to said adherent member and said bamboo leaf member being oriented with an undersurface thereof being exposed for contacting the wet slippery icy and/or snowy surfaces.

4. The assembly of claim 3 wherein said releasable adherent member is operative to releasably secure said assembly to the adjunct article or object, and is formed from a hook and loop securement material.

5. The assembly of claim 4 wherein said adjunct article or object is an article of footwear.

6. The assembly of claim 4 wherein said adjunct article or object is a mat.

7. The assembly of claim 4 wherein said adjunct article or object is an arm or knee pad.

* * * * *